United States Patent [19]

Howard et al.

[11] Patent Number: 4,569,546

[45] Date of Patent: Feb. 11, 1986

[54] PEDAL OPERATED DOOR OPENER

[75] Inventors: James M. Howard, Dover; Thomas G. Gover, Towaco, both of N.J.

[73] Assignee: Maddak, Inc., Pequannock, N.J.

[21] Appl. No.: 652,949

[22] Filed: Sep. 21, 1984

[51] Int. Cl.[4] ..... E05C 13/06

[52] U.S. Cl. ..... 292/336.3; 292/DIG. 15; 292/225; 292/255

[58] Field of Search ..... 292/94, 167, 171, 255, 292/336.3, DIG. 15, 225

[56] References Cited

U.S. PATENT DOCUMENTS

| | | | |
|---|---|---|---|
| 1,603,722 | 10/1926 | Stanley | 292/255 |
| 2,928,690 | 3/1960 | Larson | 292/336.3 |
| 2,988,392 | 6/1961 | Chikuo | 292/DIG. 1 S |
| 3,346,288 | 10/1967 | Cosentino | 292/255 X |
| 3,520,568 | 7/1970 | White et al. | 292/255 |

FOREIGN PATENT DOCUMENTS

| | | | |
|---|---|---|---|
| 116106 | 8/1926 | Switzerland | 292/255 |

*Primary Examiner*—Richard E. Moore

*Attorney, Agent, or Firm*—Anthony F. Cuoco

[57] ABSTRACT

A pedal is secured to the bottom of a door and a clamp is secured to the door knob. The pedal is coupled to the clamp through a cord or the like. Operation of the pedal by a user turns the knob through the clamp, whereby the door latch is disengaged from a latch plate in the door jamb to free the door therefrom, so that the door may be opened by the user by pushing with a hand or foot, as the case may be.

8 Claims, 3 Drawing Figures

PEDAL OPERATED DOOR OPENER

BACKGROUND OF THE INVENTION

The physically impaired or the infirm, and particularly those confined to wheelchairs or the like, have difficulty in opening doors to permit passage from one room to another of a dwelling or other building. For example, it is particularly difficult to open a door and at the same time to maneuver a wheelchair through the door opening. Prior to the present invention, there has been no effective way known to the inventors hereof for accomplishing this other than with the assistance of others. This assistance is not always available and is otherwise a burden. Accordingly, it is an object of the present invention to provide means for opening a door with a minimum effort on the part of the user, and particularly adaptable to the physically impaired or the like who are otherwise unable to open a door in the conventional manner.

SUMMARY OF THE INVENTION

This invention contemplates a pedal operated door opener, including a pedal secured to the door and a clamp secured to the door knob and coupled to the pedal through a cord or the like. Actuation of the pedal by a user applies tension to the cord, causing the clamp to turn the knob, whereupon the door latch is disengaged from the latch plate in the door jamb. The door is thereupon freed from the door jamb and may be pulled or pushed open by the foot or otherwise of the user. The pedal rests on the floor through a wheel or a caster, or the like, so as not to impede fully opening the door once it is freed from the door jamb. The pedal may be spring biased so that it returns to its normal position after being actuated by the user. The pedal may be hinged to the door by a friction lock spring so as to be fixedly displaced away from the door when not in use.

DETAILED DESCRIPTION OF THE INVENTION

Figure 1:
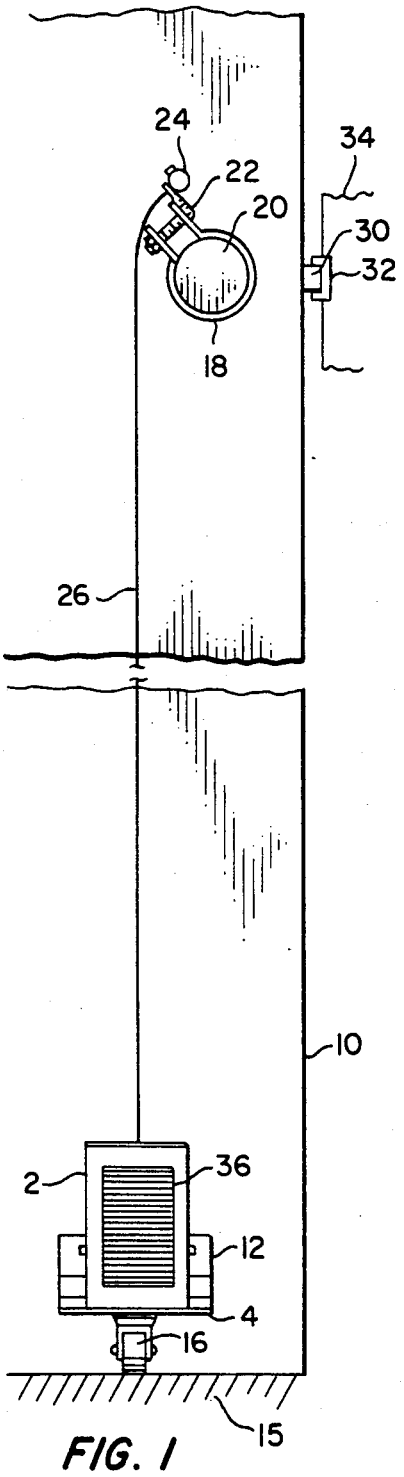
FIG. 1 is a diagrammatic front view representation of the pedal operated door opener of the invention.

With reference to the drawing, a pedal 2 is secured to the outer end of a base 4 by a hinge 6 biased by a spring 8. The other or inner end of base 4 is hinged to the bottom of a door 10 by a hinge 12 biased by a spring 14. Base 4 rests on a supporting surface or floor 15 through a wheel or caster 16 secured to the underside of the base.

A clamp 18 surrounds a knob 20 on door 10. Clamp 18 may be in the nature of a conventional pipe clamp or the like and is secured to knob 18 by a thumb screw 22 or the like so that the clamp turns with the knob. A cord fastener 24 is suitably mounted to clamp 18.

Figure 2:
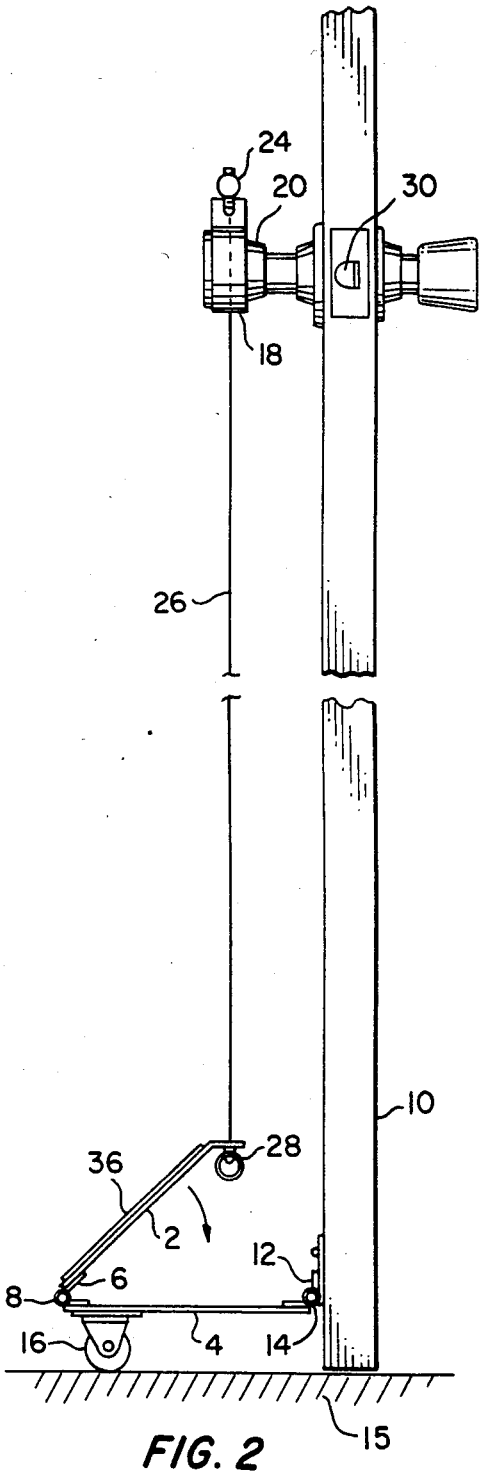
FIG. 2 is a diagrammatic side view representation thereof.

As particularly shown in FIG. 2, a cord or the like 26 is fastened to cord fastener 24 and is fastened to a cord ring or the like 28 suitably secured to pedal 2.

Figure 3:
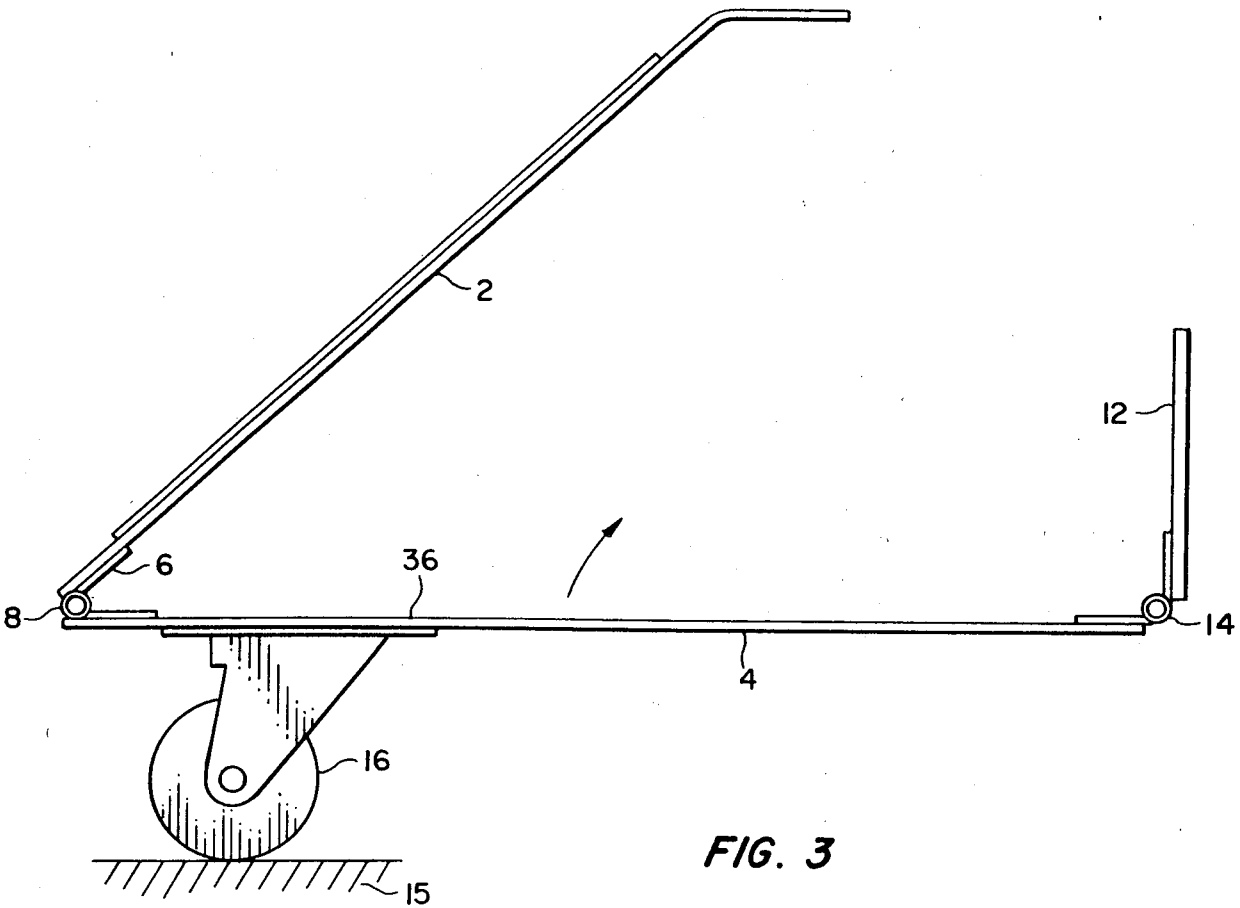
FIG. 3 is a diagrammatic side view best showing the pedal arrangement used in the invention.

With pedal 2 shown in its normal position as in FIGS. 2 and 3, there is no tension on cord 2 and a door latch 30 engages a latch plate 32 on a door jamb 34 as best shown in FIG. 1.

When pedal 2 is actuated by the foot of a user in a downward direction as shown by the arrow in FIG. 2, tension is applied to cord 26 whereby clamp 18 and door knob 20 turn so that door latch 30, coupled to knob 20 in a conventional manner, is disengaged from latch plate 32 to free door 10 from door jamb 34. Door 10 may thereupon be opened to its full extent by the user pushing or pulling the door with the foot or otherwise, as the case may be.

The foot operation of the invention is enhanced by pedal 2 carrying a suitable tread surface 36 of rubber or the like as best shown in FIG. 1.

With particular reference to FIG. 3, spring 8 may be of the type for biasing pedal 2 to its normal position. That is to say, when the user removes the foot from the pedal after actuating the pedal downward as heretofore described to free door 10 from door jamb 34, the spring returns the pedal to its normal position as shown in the Figure.

With continued reference to FIG. 3, spring 14 may be of the readily available friction lock type. That is to say, when the devise of the invention is not in use, base 4 may be actuated upward as shown by the arrow in FIG. 3, whereupon spring 14 maintains base 4 and pedal 2 in a raised position away from floor 15 and toward door 10.

There has thus been described a pedal operated door opener particularly useful to the physically impaired or the infirm who might otherwise be unable to open a door in the conventional manner with any degree of facility. With the above description in mind, reference is had to the claims appended hereto for a definition of the scope of the invention.

What is claimed is:

1. A pedal operated opener for a door characterized by:

pedal means for being secured to the bottom of the door and for being actuable relative thereto;

a door knob of the type arranged with a latch on a door for disengaging the latch from a latch plate carried by a door jamb when the knob is turned, so as to free the door from the door jamb for opening the door;

clamping means clamped to the door knob and turning therewith;

means for coupling the pedal means to the clamping means so as to turn the clamping means and the knob therewith upon the actuation of the pedal means;

the pedal means including a base, a pedal, a hinge mounted to the pedal and the base for hinging the pedal to one end of the base so that the pedal is actuable away from and toward said base, and resilient means arranged with the hinge for biasing the pedal in a normal position away from the base and for returning the pedal to the normal position after the pedal has been actuated toward the base for turning the clamping means and the knob therewith through the coupling means;

supporting means secured to the underside of the base for displaceably supporting the base on a supporting surface so that the base is displaced on said supporting surface when the door is opened;

an other hinge mounted to the base for mounting to the door for hinging the end of the base opposite the one end to the bottom of the door so that the base is actuable away from and toward the door; and other resilient means associated with the pedal operated door opener including retaining means for retaining the base in a fixed position toward the door when the base is displaced through said other hinge away from the supporting surface and toward said door.

2. A pedal operated opener for a door as described by claim 1, wherein the means for coupling the pedal means to the clamping means is characterized by:

a cord secured at one end to the clamping means and secured at the other end to the pedal means; and a tension being applied to the cord upon actuation of the pedal means, said tension being effective for turning the clamping means and the knob therewith upon actuation of the pedal means.

3. A pedal operated opener for a door as described by claim 1, further characterized by:

the pedal having an actuating surface and a tread on said surface for foot actuation thereof.

4. For use with a door of the type having a door knob, a latch coupled to the door knob and operable when the door knob is turned for disengaging the latch from a latch plate carried by a door jamb so as to free the door for opening, pedal operated means characterized by:

a base for attachment to the door and a hinge mounted to the base for hinging one end of the base to the bottom of the door so that the base is displaced toward and away from said door;

a pedal and a hinge mounted to the pedal and the base for hinging the pedal to the end of the base opposite the one end so that the pedal is displaceable toward and away from said base;

for clamping means clamped to the door knob and turning therewith; and means for clamping the pedal to the clamping means so as to turn the clamping means and the knob therewith upon displacing the pedal toward the base.

5. Pedal operated means as described by claim 4, characterized by:

resilient means arranged with the pedal hinge for biasing the pedal in a normal position away from the base, and for returning the pedal to said normal position after the pedal has been displaced toward the base.

6. Pedal operated means including retaining means as described by claim 4, characterized by:

resilient means arranged with the base hinge for retaining the base in a fixed position toward the door when the base is displaced to said position.

7. Pedal operated means as described by claim 4, characterized by:

supporting means secured to the underside of the base for displaceably supporting the base on a supporting surface so that the base is displaced on said supporting surface when the door is opened.

8. Pedal operated means as described by claim 4, wherein the means for clamping the pedal to the clamping means and for turning the clamping means and the knob therewith upon displacing the pedal toward the base is characterized by:

a cord secured at one end to the clamping means and secured at the other end to the pedal; and a tension being applied to the cord upon displacing the pedal toward the base, said tension being effective for turning the clamping means and the knob therewith upon displacement of the pedal toward the base.

* * * * *